US009883282B2

(12) United States Patent
Goksel et al.

(10) Patent No.: US 9,883,282 B2
(45) Date of Patent: Jan. 30, 2018

(54) ACOUSTIC DEFLECTOR FOR OMNI-DIRECTIONAL SPEAKER SYSTEM

(71) Applicant: Bose Corporation, Framingham, MA (US)

(72) Inventors: Bulent Goksel, Braintree, MA (US); Wontak Kim, Watertown, MA (US); Joseph Jankovsky, Holliston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/222,296

(22) Filed: Jul. 28, 2016

(65) Prior Publication Data

US 2016/0337748 A1 Nov. 17, 2016

Related U.S. Application Data

(63) Continuation-in-part of application No. 14/643,216, filed on Mar. 10, 2015, now Pat. No. 9,544,681.

(60) Provisional application No. 62/110,493, filed on Jan. 31, 2015.

(51) Int. Cl.
*H04R 1/34* (2006.01)
*H04R 1/28* (2006.01)

(52) U.S. Cl.
CPC ..... *H04R 1/345* (2013.01); *H04R 1/2896* (2013.01); *H04R 1/2834* (2013.01); *H04R 2201/405* (2013.01)

(58) Field of Classification Search
CPC ..... H04R 1/30; H04R 1/345; H04R 1/2819; H04R 2201/34
See application file for complete search history.

(56) References Cited

U.S. PATENT DOCUMENTS 3,912,866 A * 10/1975 Fox ..... H04R 1/2865 181/155
4,322,578 A * 3/1982 Selmin ..... H04R 1/26 181/175
4,348,549 A * 9/1982 Berlant ..... H04R 1/26 181/152
4,620,317 A 10/1986 Anderson
5,115,882 A * 5/1992 Woody ..... H04R 1/345 181/144
5,268,538 A 12/1993 Queen
(Continued)

FOREIGN PATENT DOCUMENTS

DE 102011016326 A1 10/2012
EP 0518668 A2 12/1992

OTHER PUBLICATIONS

McRitchie, Don, "Aquarius: A Noble Experiment", Audioheritage.com, 2001, accesses Mar. 5, 2015, 9 pages.
(Continued)

*Primary Examiner* — Matthew Eason

(57) ABSTRACT

An omni-directional acoustic deflector includes an acoustically reflective body that has a truncated conical shape which includes a substantially conical outer surface that is configured to be disposed adjacent an acoustically radiating surface (e.g., a diaphragm) of an acoustic driver thereby to define an acoustic radiation path therebetween. The acoustically reflective body is profiled such that a cross-sectional area of the acoustic radiation path increases monotonically with respect to radial distance from a motion axis of the acoustic driver.

16 Claims, 10 Drawing Sheets

(56) References Cited

U.S. PATENT DOCUMENTS

| | | | | |
|---|---|---|---|---|
| 6,009,972 | A | 1/2000 | Choi et al. | |
| 6,026,928 | A * | 2/2000 | Maharaj | H04R 1/30 181/152 |
| 6,064,744 | A | 5/2000 | Augustin | |
| 6,257,365 | B1 * | 7/2001 | Hulsebus, II | H04R 1/34 181/155 |
| 6,597,797 | B1 * | 7/2003 | Betts | H04R 1/345 181/155 |
| 8,130,994 | B2 | 3/2012 | Button et al. | |
| 8,181,736 | B2 | 5/2012 | Sterling et al. | |
| 8,290,195 | B2 * | 10/2012 | Chick | H04R 1/36 181/175 |
| 8,418,802 | B2 * | 4/2013 | Sterling | H04R 1/345 181/167 |
| 8,467,557 | B2 * | 6/2013 | Miller | H04R 1/24 381/182 |
| 8,672,088 | B2 | 3/2014 | Sterling et al. | |
| 8,750,540 | B2 * | 6/2014 | Tan | H04R 1/345 181/144 |
| 9,282,398 | B2 * | 3/2016 | Monroe | H04R 1/22 |
| 2002/0011379 | A1 | 1/2002 | Taylor | |
| 2003/0141142 | A1 * | 7/2003 | Christiansen | H04R 1/345 181/199 |
| 2008/0192972 | A1 * | 8/2008 | Lewallen | H04R 23/00 381/343 |
| 2009/0245561 | A1 | 10/2009 | Litovsky et al. | |
| 2009/0310808 | A1 * | 12/2009 | Button | H04R 1/24 381/339 |
| 2012/0076328 | A1 | 3/2012 | Harwood | |
| 2012/0201403 | A1 | 8/2012 | Tan | |
| 2013/0228393 | A1 * | 9/2013 | Sterling | H04R 1/345 181/150 |
| 2014/0321686 | A1 * | 10/2014 | Wegener | H04R 1/028 381/332 |
| 2016/0227315 | A1 * | 8/2016 | Kim | H04R 1/2819 |
| 2016/0337748 | A1 * | 11/2016 | Goksel | H04R 1/2896 |
| 2017/0006376 | A1 * | 1/2017 | Tan | H04R 1/20 |
| 2017/0094403 | A1 | 3/2017 | Tipparaju et al. | |

OTHER PUBLICATIONS

International Search Report and Written Opinion dated Apr. 7, 2016 for International application No. PCT/US2016/015521.

International Search Report and Written Opinion dated Apr. 6, 2017 for International application No. PCT/US2016/044682.

Invitation to Pay Additional Fees dated Apr. 5, 2017 for International application No. PCT/US2016/044680.

International Search Report and Written Opinion dated Jun. 28, 2017 for International application No. PCT/US2016/044680.

Visaton—Der Lautsprecherspezialist: "Kegel fur Rundstrahler", Apr. 8, 2012, pp. 1-8, XP055383099, retrieved from the Internet URL: http://www.visaton.de/vb/showthread.php?t=235448,highlight=f%C3YDBC11en [retrieved on Jun. 20, 2017], p. 2—"Henrik" dialog input, p. 3—"walwal" 1st dialog input, p. 5—"walwal" dialog input.

* cited by examiner

ACOUSTIC DEFLECTOR FOR OMNI-DIRECTIONAL SPEAKER SYSTEM

RELATED APPLICATION

This application is a continuation-in-part application of U.S. patent application Ser. No. 14/643,216, filed Mar. 10, 2015 and titled "Acoustic Deflector for Omni-Directional Speaker System," which claims benefit from U.S. Provisional Patent Application No. 62/110,493, filed Jan. 31, 2015 and titled "Acoustic Deflector for Omni-Directional Speaker System," the contents of which are incorporated herein by reference.

BACKGROUND

Conventional acoustic deflectors in speaker systems can exhibit artifacts in the acoustic spectrum due to acoustic modes present due to the presence of an acoustic driver and an acoustic deflector. This disclosure relates to an acoustic deflector for equalizing the resonant response for an omni-directional speaker system.

SUMMARY

All examples and features mentioned below can be combined in any technically possible way.

In one aspect, an omni-directional acoustic deflector includes an acoustically reflective body that has a truncated conical shape which includes a substantially conical outer surface. The substantially conical outer surface is configured to be disposed adjacent an acoustically radiating surface (e.g., a diaphragm) of an acoustic driver thereby to define an acoustic radiation path therebetween. The acoustically reflective body is profiled such that a cross-sectional area of the acoustic radiation path increases monotonically with respect to radial distance from a motion axis of the acoustic driver.

Implementations may include one of the following features, or any combination thereof.

In some implementations, the substantially conical outer surface has a steeper slope than the acoustically radiating surface.

In certain implementations, the substantially conical outer surface has a linear slant profile, wherein the cross-sectional area of the acoustic radiation path increases in a linear fashion with respect to distance from a motion axis of the acoustic driver.

In some examples, the substantially conical outer surface has a non-linear slant profile, wherein the cross-sectional area of the acoustic radiation path increases in a nonlinear fashion with respect to distance from a motion action of the acoustic driver. For example, the substantially conical outer surface can have a substantially parabolic profile.

In certain examples, the acoustically reflective body includes one or more features that extend into the acoustic radiation path and which disrupt a circular symmetry of the acoustic body, and thereby reduce the ability of the acoustic radiation path to support circularly symmetric modes.

In some cases, the omni-directional acoustic deflector includes a leg (a/k/a a "mounting pillar") for coupling the acoustically reflective body to the acoustic driver, and the one or more features include a radial extension that extends from the acoustically reflective body to the at least one leg.

In certain cases, the acoustically reflective body includes a top surface that is configured to be centered with respect to a motion axis of the acoustic driver. The acoustically reflective body has an opening in the top surface, and the omni-directional deflector includes an acoustically absorbing material disposed at the opening in the top surface.

In some implementations, one or more openings are provided along a circumference of the acoustically reflective body to allow for air flow between the acoustic radiation path and a body cavity of the acoustically reflective body, thereby to disrupt or inhibit resonance modes.

Another aspect features a speaker system that includes an acoustic enclosure, an acoustic driver coupled to the acoustic enclosure, and an omni-directional acoustic deflector that is coupled to the acoustic enclosure adjacent the acoustic driver to receive acoustic energy propagating from the acoustic driver. The omni-directional acoustic deflector includes an acoustically reflective body that has a truncated conical shape which includes a substantially conical outer surface that is configured to be disposed adjacent an acoustically radiating surface of the acoustic driver thereby to define an acoustic radiation path therebetween. A slant profile of the substantially conical outer surface does not correspond to that of the acoustically radiating surface.

Implementations may include one of the above and/or below features, or any combination thereof.

In some implementations, the acoustically reflective body is profiled such that a cross-sectional area of the acoustic radiation path increases monotonically with respect to radial distance from a motion axis of the acoustic driver.

In some examples, the profile of the substantially conical outer surface has a steeper slope than the acoustically radiating surface.

In certain examples, the substantially conical outer surface comprises a non-linear profile.

In some cases, the substantially conical outer surface has a substantially parabolic profile.

In certain cases, the substantially conical outer surface comprises a linear profile.

In some implementations, the speaker system also includes at least one passive radiator.

In certain implementations, the acoustically reflective body includes one or more features that extend into the acoustic radiation path and which disrupt a circular symmetry of the acoustic body, and thereby reduce the ability of the acoustic radiation path to support circularly symmetric modes.

In some examples, one or more openings are provided along a circumference of the acoustically reflective body to allow for air flow between the acoustic radiation path and a body cavity of the acoustically reflective body, thereby to disrupt or inhibit resonance modes.

DETAILED DESCRIPTION

Multiple benefits are known for omni-directional speaker systems. These benefits include a more spacious sound image when the speaker system is placed near a boundary, such as a wall within a room, due to reflections. Another benefit is that the speaker system does not have to be oriented in a particular direction to achieve optimum high frequency coverage. This second advantage is highly desirable for mobile speaker systems where the speaker system and/or the listener may be moving.

Figure 1A:
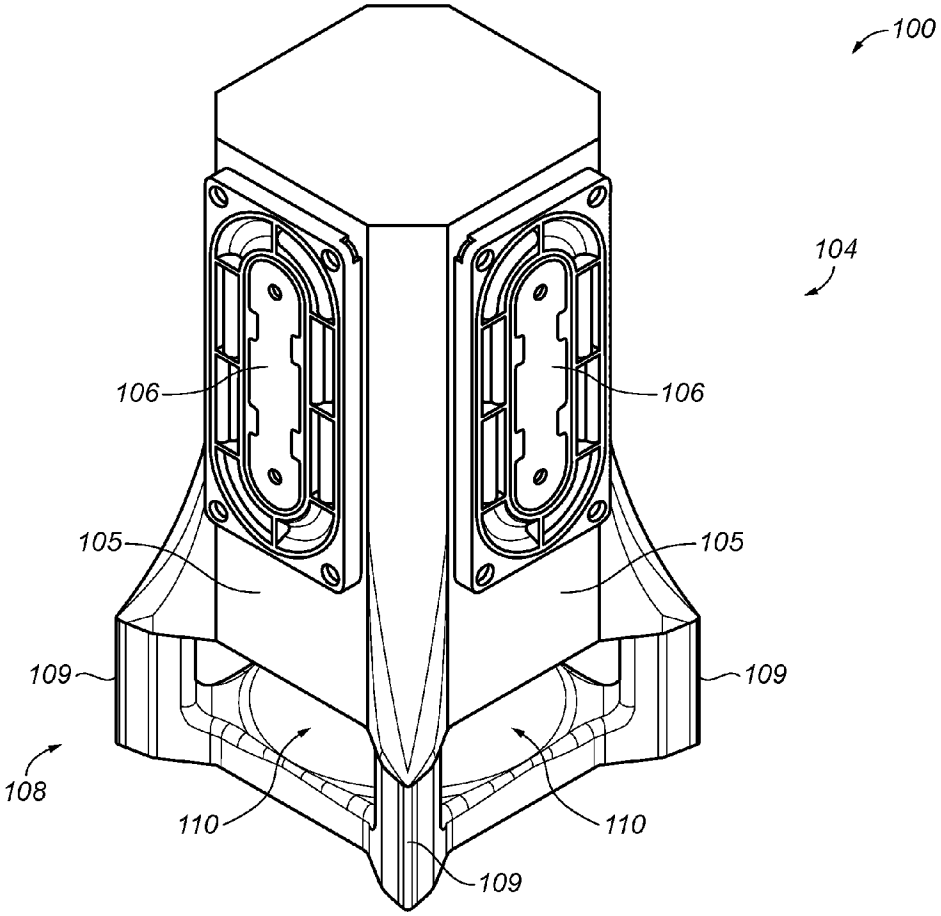
FIG. 1A is a perspective view of an omni-directional speaker system having a single acoustic driver inside a vertical acoustic enclosure.
Figure 1B:
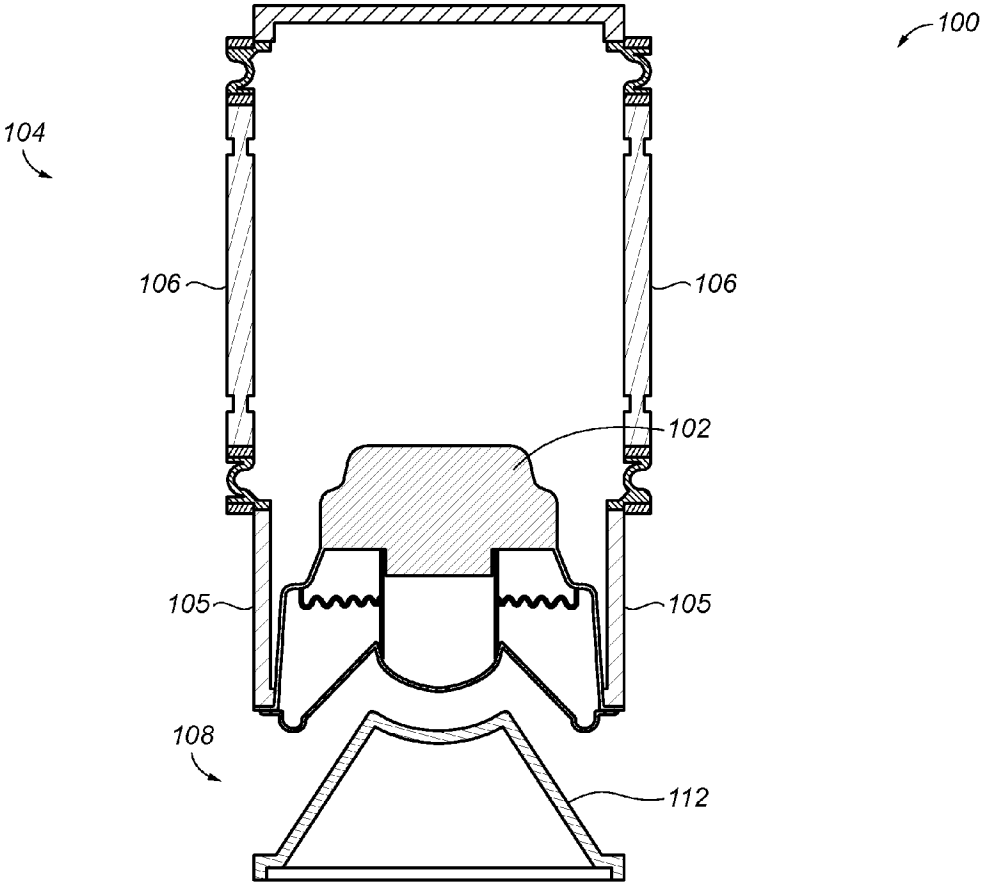
FIG. 1B is a cross-sectional view of the omni-directional speaker system shown in FIG. 1A.

FIGS. 1A and 1B are drawings showing a perspective view and a cross-sectional view, respectively, of a speaker system 100 that includes a single downward firing acoustic driver 102 (FIG. 1B) secured to a vertical acoustic enclosure 104. Each side wall 105 of the enclosure 104 includes a passive radiator 106. In some examples, two opposing passive radiators 106 are configured to be driven by audio signals from an audio source (not shown) such that each opposing pair of passive radiators 106 are driven acoustically in phase with each other and mechanically out of phase with each other, to minimize vibration of the enclosure 104.

Two opposing pairs of passive radiators 106 (for a total of four passive radiators) may be used, as shown in the figures. The passive radiators 106 may be located on an outer wall 105 of the enclosure 104, as depicted, or instead be located within the enclosure 104 and configured to radiate acoustic energy through slots located in the enclosure 104 (not shown). One or more of the passive radiators 106 may be oriented vertically or horizontally within the enclosure 104.

The volume within the region above the acoustic driver 102 and inside the enclosure 104, as "sealed" with the passive radiators 106, defines an acoustic chamber. The diaphragms of the passive radiators 106 are driven by pressure changes within the acoustic chamber.

The speaker system 100 also includes an omni-directional acoustic deflector 108 having four vertical legs 109 (a/k/a "mounting pillars") to which the enclosure 104 is mounted. Acoustic energy generated by the acoustic driver 102 propagates downward and is deflected into a nominal horizontal direction by an acoustically reflective body 112 of the acoustic deflector 108.

There are four substantially rectangular openings 110. Each opening 110 is defined by the base of the enclosure 104, the base of the acoustic deflector 108 and a pair of the vertical legs 109. These four openings 110 are acoustic apertures which pass the horizontally propagating acoustic energy. It should be understood that the propagation of the acoustic energy in a given direction includes a spreading of the propagating acoustic energy, for example, due to diffraction.

The illustrated acoustic deflector 108 has a nominal truncated conical shape. In other examples, the slope of the conical outer surface between the base and vertex of the cone (a/k/a "cone axis") is not constant. For example, the surface may have a non-linear slant profile such as a parabolic profile (such as described below with reference to the implementation illustrated in FIG. 5A) or a profile described by a truncated hyperboloid of revolution. The body of the acoustic deflector 108 can be made of any suitably acoustically reflective material. For example, the body may be formed from plastic, stone, metal or other rigid material, or any suitable combinations thereof.

Figure 2:
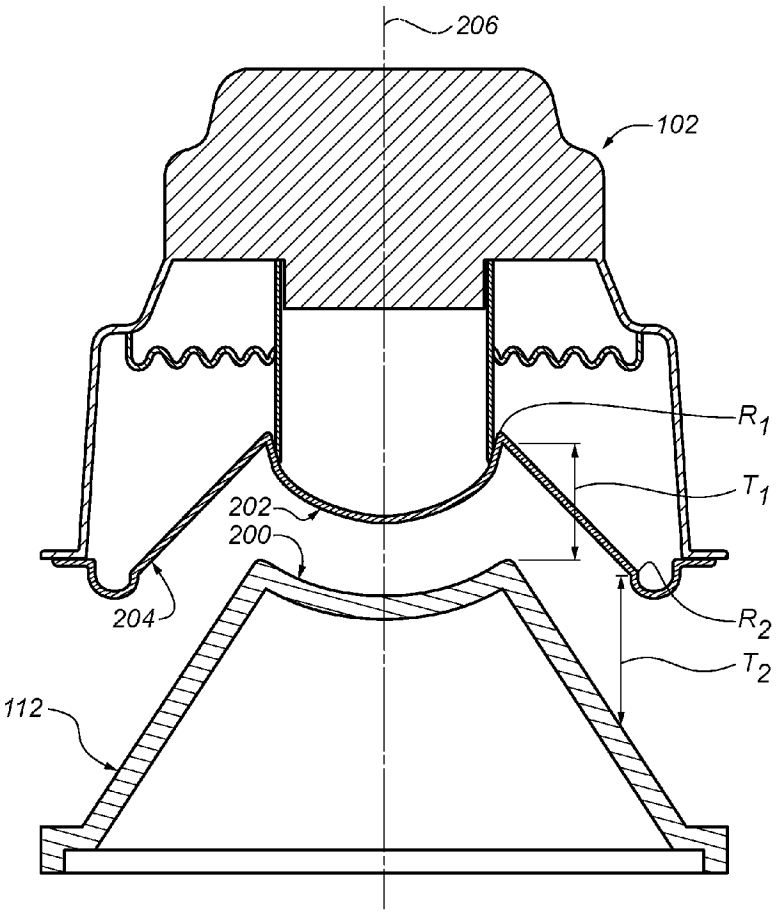
FIG. 2 is a cross-sectional view of the omni-directional acoustic deflector and the acoustic driver in the speaker system of FIG. 1A.

Reference is also made to FIG. 2 which shows a cross-sectional view of the omni-directional acoustic deflector 108 and the acoustic driver 102. The top surface 200 of the acoustically reflective body 112 is shaped to accommodate the excursions of a central dust cap 202, centered on the face 204 of the acoustic driver 102, during operation of the speaker system. The conventional conical shape of the acoustic deflector 108 results in significant colorization of the acoustic spectrum, especially at higher acoustic frequencies, due to resonances in the volume between the acoustically radiating surfaces (i.e., the face 204 and the dust cap 202) of the acoustic driver 102 and acoustically reflective surfaces (i.e., the conical outer surface and top surface 200) of the acoustically reflective body 112.

Notably, the profile of the acoustically reflective body 112 is shaped such that a cross-sectional area of the acoustic radiation path (i.e., the volume between the face 204 and the acoustically reflective body 112 and extending from the periphery of the top surface 200 to the openings 110) increases monotonically with respect to radial distance from a motion axis 206 of the acoustic driver 102, which is coincident with the cone axis. That is T2, which corresponds to the separation between face 204 and the acoustically reflective body 112 at an outer radius R2 of the face 204, is greater than T1, which corresponds to the separation between face 204 and the acoustically reflective body 112 at an inner radius R1 of the face 204. This monotonically increasing area can help to provide an improvement in the acoustic spectrum as compared to configurations in which the cross-section area of the acoustic radiation path remains substantially constant, such as where the profile of the acoustically reflective body substantially conforms the profile of the face/diaphragm of the acoustic driver.

Figure 3:
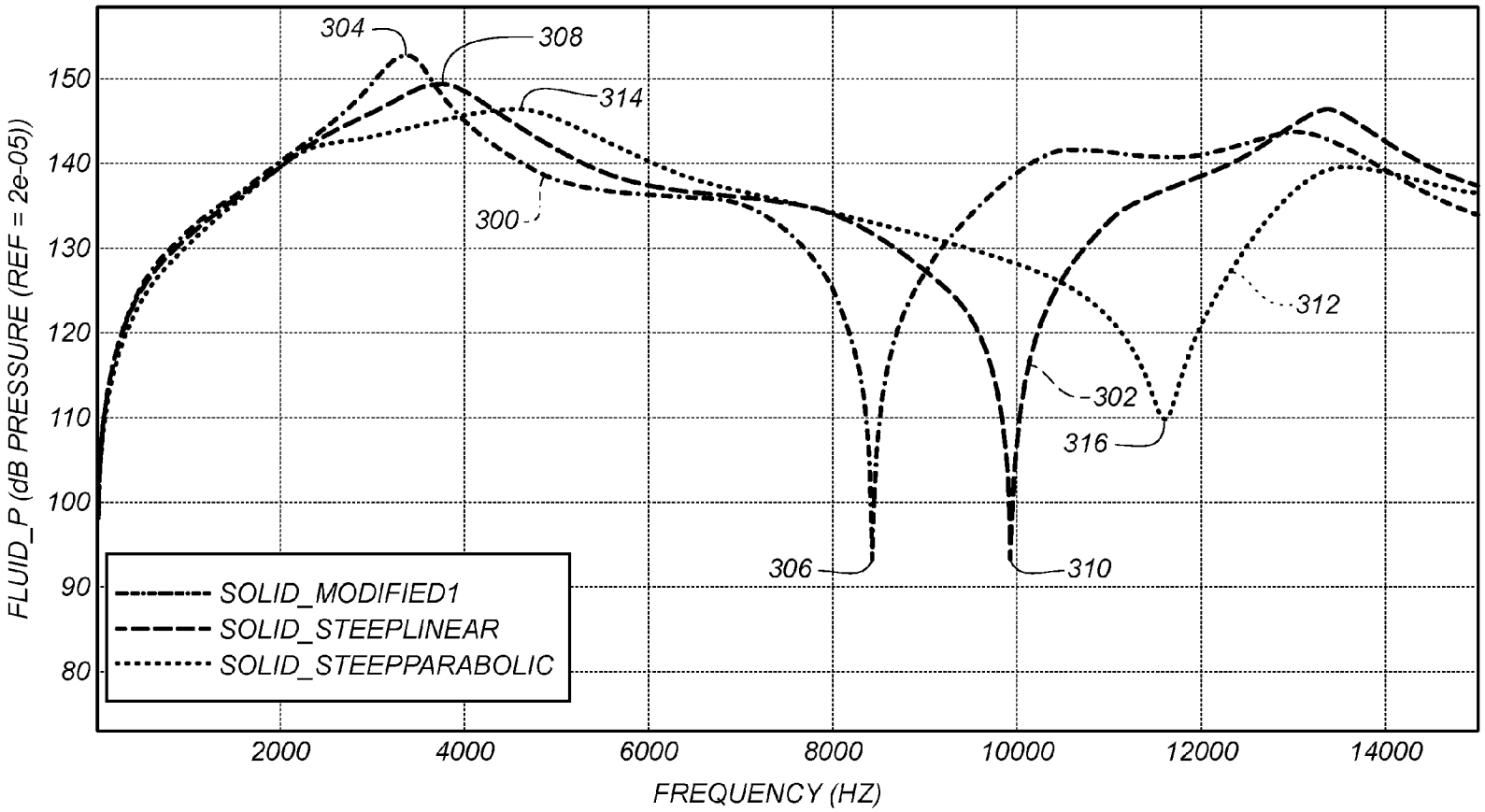
FIG. 3 is a plot of the nearfield sound pressure level as a function of frequency for the various omni-directional acoustic deflector geometries shown in FIGS. 4A through 4C.

FIG. 3 is a plot of the acoustic nearfield pressure level as a function of acoustic frequency for various system configurations having deflectors of differing profile shapes. Curve 300 corresponds to the system configuration of FIG. 4A, which includes a substantially conically shaped deflector 400 having a profile that substantially conforms to a face 402 of the acoustic driver 404 (i.e., the slope of the conical surface of the deflector matches, and remains substantially parallel to, that of the face 402 of the acoustic driver 404), resulting in an acoustic radiation path 406 that remains substantially constant with respect to radial distance from a motion axis 408 of the acoustic driver 404. Curve 302 corresponds to the system configuration of FIG. 4B, which includes a substantially conically shaped deflector 410 having a profile that results in an acoustic radiation path 412 that increases monotonically with respect to radial distance from a motion axis 414 of the acoustic driver 416 (i.e., the slope of the conical surface of the deflector differs from, and is non-parallel to, that of the face 418 of the acoustic driver 416), similar to the configuration of FIG. 2.

As shown in FIG. 3, the curve 300 includes a significant acoustic resonance 304 in the acoustic response at about 3.5 kHz, as well as a significant null 306 at about 8.5 kHz. These peaks and nulls can be problematic for tuning, requiring extra tuning time to alleviate. To alleviate these problems it can be desirable to displace those peaks and nulls as high in the frequency range as possible, and to make the peaks and nulls as flat as possible. By comparison, the curve 302 shows improvement in that peak 308 is reduced in magnitude ("flattened") as compared to peak 304, and it is pushed out higher in the frequency range (i.e., to about 3.9 kHz). In addition, null 310 of curve 302 is pushed farther out (higher) in the frequency range (i.e., to about 10 kHz). What this demonstrates is that configuration of FIG. 4B exhibits improved performance and requires less tuning as compared to the configuration of FIG. 4A.

Figure 4C:
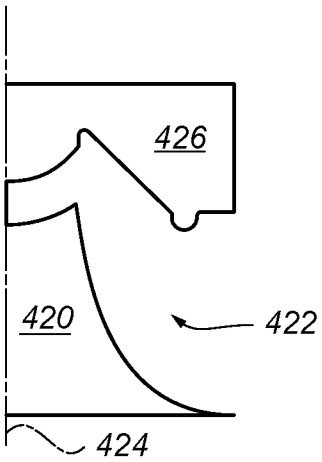
FIG. 4C is a schematic side view showing an omni-directional acoustic deflector having a substantially parabolic shaped deflector having a non-linear profile that results in an acoustic radiation path that increases monotonically with respect to radial distance from a motion axis of an associated acoustic driver.
Figure 4B:
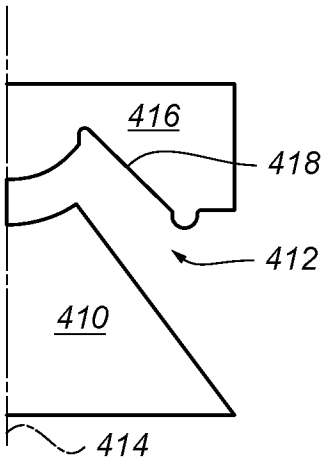
FIG. 4B is a schematic side view showing an omni-directional acoustic deflector having an substantially conically shaped deflector with a profile that results in an acoustic radiation path that increases monotonically with respect to radial distance from a motion axis of an associated acoustic driver.
Figure 4A:
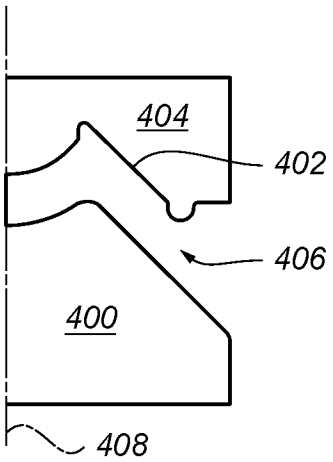
FIG. 4A is a schematic side view showing an omni-directional acoustic deflector having an substantially conically shaped deflector with a profile that substantially conforms to a radiating surface of an associated acoustic driver.

Referring still to FIG. 3, curve 312 corresponds to the system configuration of FIG. 4C, which includes a substantially parabolic shaped deflector 420 having a non-linear profile that, like the deflector of FIG. 4B, results in an acoustic radiation path 422 that increases monotonically with respect to radial distance from a motion axis 424 of the acoustic driver 426. The curve 312 shows improved performance of the configuration of FIG. 4C over the configurations of FIGS. 4A and 4B. In that regard, curve 312 shows a peak 314 that is lower in magnitude and that is pushed out to a higher frequency, e.g., about 4.5 kHz, as compared to the peaks 304 and 308 of curves 300 and 302, respectively. In addition, curve 312 exhibits a null 316 that is more shallow (i.e., and that is pushed out to a higher frequency, e.g., to about 11.5 kHz, as compared to the nulls 306 and 310 of curves 300 and 302, respectively. This demonstrates that the configuration of FIG. 4C exhibits improved performance (i.e., a flatter response) and requires less tuning as compared to the configurations of FIGS. 4A and 4B.

Figure 5A:
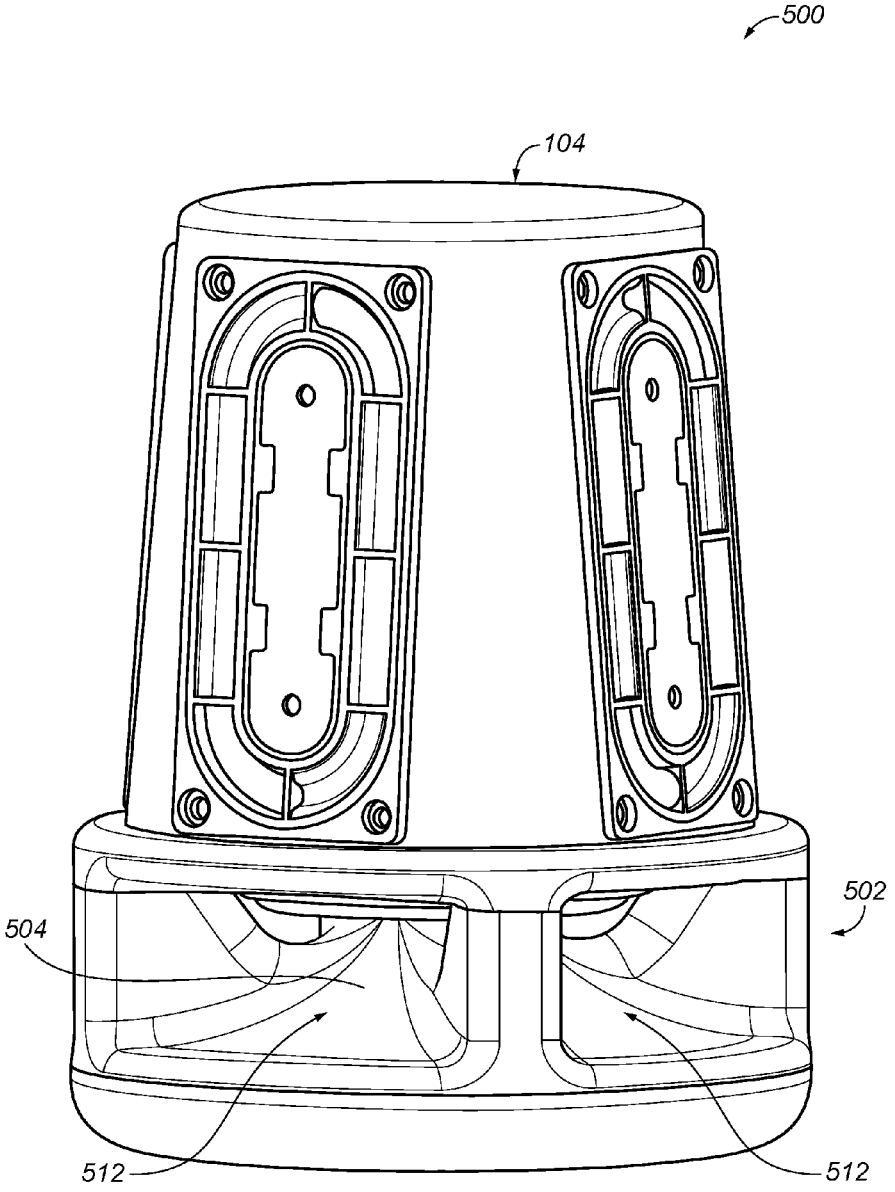
FIG. 5A is a perspective view of one example of an omni-directional speaker system having an omni-directional acoustic deflector to reduce the negative effects of resonances on the acoustic spectrum according to principles described herein.
Figure 5B:
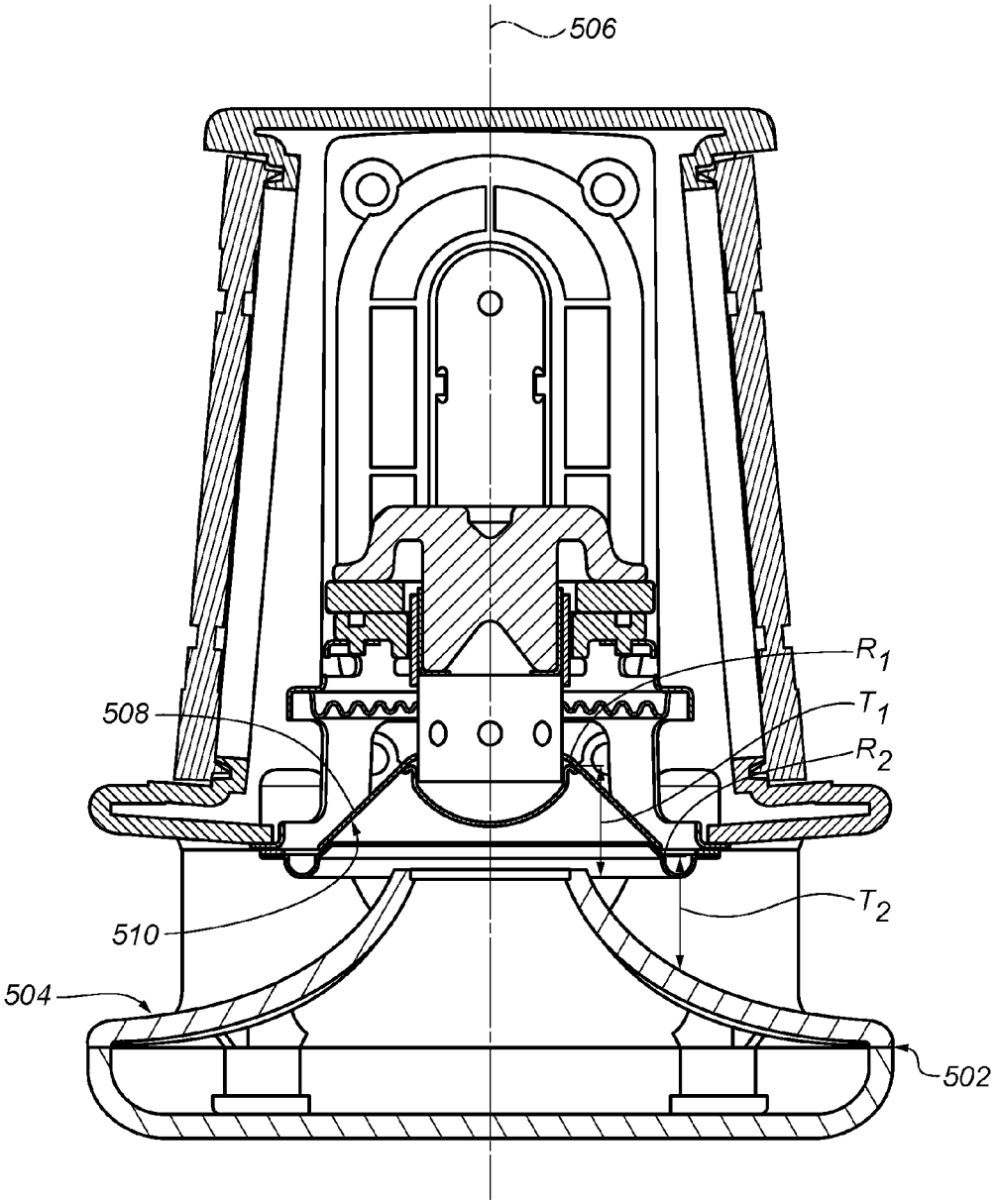
FIG. 5B is a cross-sectional view of the omni-directional speaker system of FIG. 5A.

FIGS. 5A and 5B are illustrations showing a perspective view and cross-sectional view, respectively, of an example of an omni-directional speaker system 500 having an omni-directional acoustic deflector 502 disposed below a single downward firing acoustic driver 504. The omni-directional acoustic deflector 502 is configured to reduce the negative effects of resonances on the acoustic spectrum as described below. The illustrated speaker system 500 is substantially similar to the speaker system 100 shown in FIGS. 1A and 1B except for the omni-directional acoustic deflector 502 which has different geometric and material features.

Notably, the acoustically reflective body 504 is provided with a non-linear slant profile (shown as a parabolic profile) that is configured such that a cross-sectional area of the acoustic radiation path (i.e., the volume between the face 510 and the acoustically reflective body 504 and extending from an inner radius 600 (FIGS. 6A & 6B) of the acoustically reflective body 504 to the openings 512) increases monotonically with respect to radial distance from a motion axis 506 of the acoustic driver 508. That is T2, which corresponds to the separation between face 510 and the acoustically reflective body 504 at an outer radius R2 of the face 510, is greater than T1, which corresponds to the separation between face 510 and the acoustically reflective body 504 at an inner radius R1 of the face 510.

As in the case of the system 100 described above with respect to FIGS. 1A and 1B, this monotonically increasing area can help to provide an improvement in the acoustic spectrum as compared to configurations in which the cross-section area of the acoustic radiation path remains substantially constant, such as where the profile of the acoustically reflective body substantially conforms the profile of the face/diaphragm of the acoustic driver. Additionally, with reference to FIG. 4 (cf. curves 302 and 312), a parabolic profile demonstrates improved performance (i.e., flatter spectrum) even over an acoustically reflective body with a substantially conically shaped profile that is similarly configured such that a cross-sectional area of the acoustic radiation path increases monotonically with respect to radial distance from a motion axis of the acoustic driver.

Figure 6A:
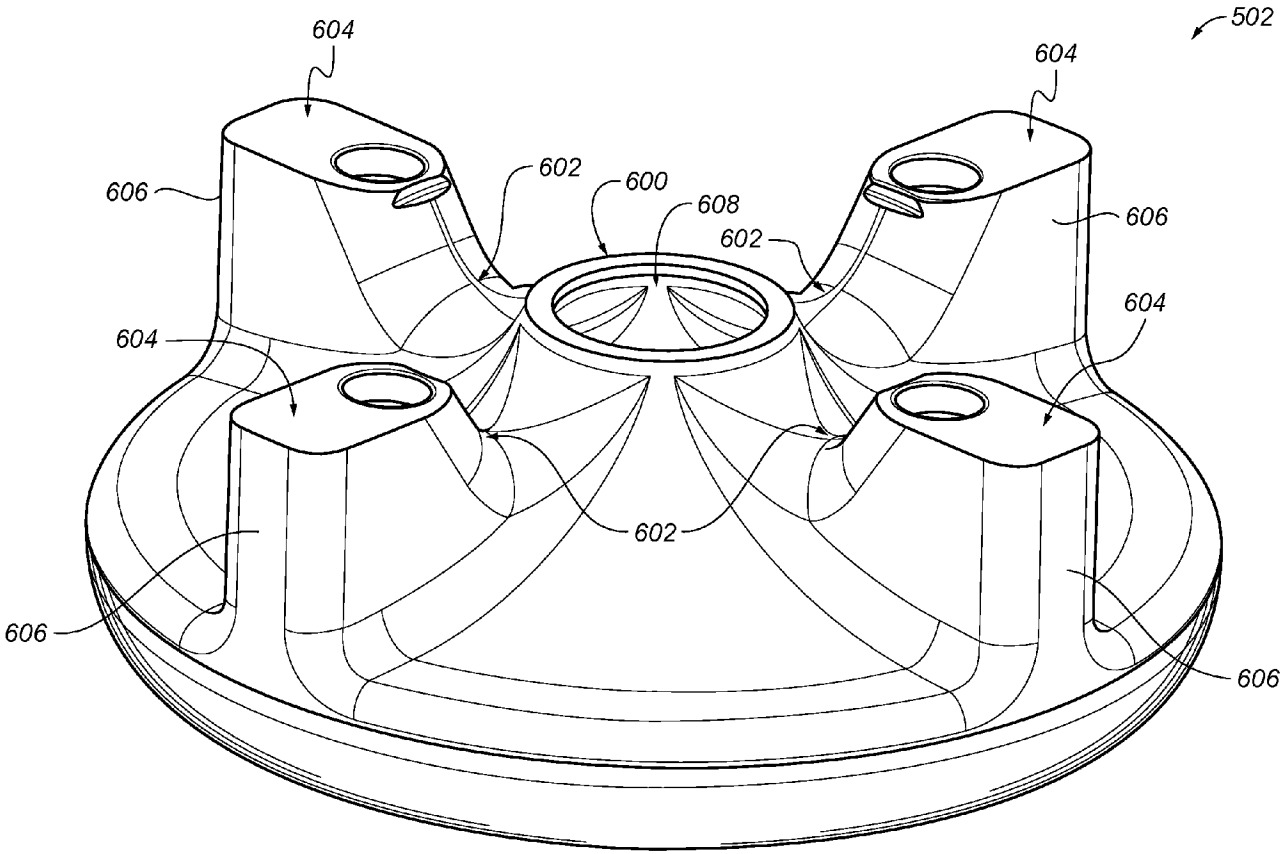
FIG. 6A is a perspective view of the omni-directional acoustic deflector in the omni-directional speaker system of FIG. 5A.
Figure 6B:
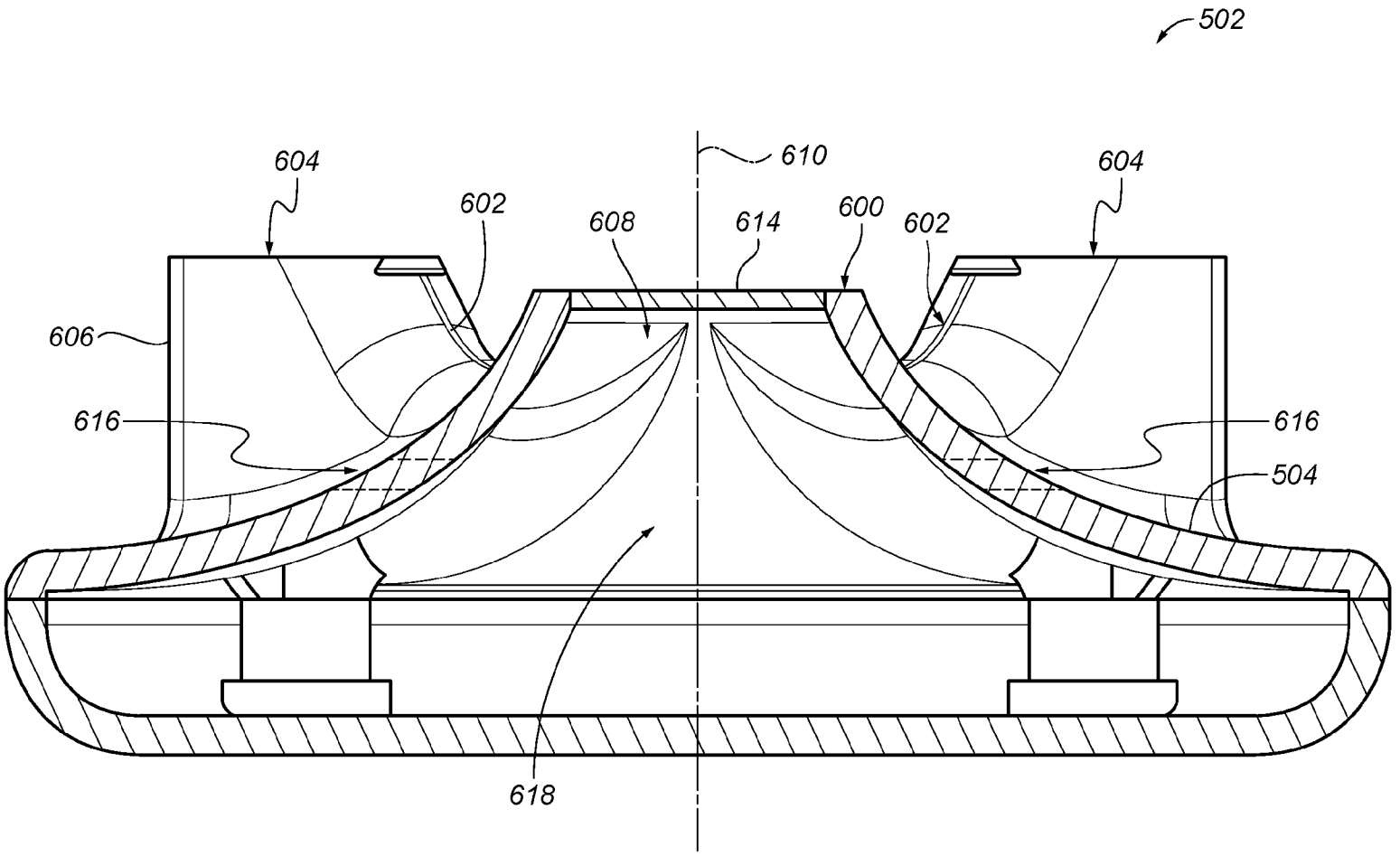
FIG. 6B is a cross-sectional view of the omni-directional acoustic deflector shown in FIG. 6A.

FIGS. 6A and 6B are perspective and cross-sectional views, respectively, of the omni-directional acoustic deflector 502. The omni-directional acoustic deflector 502 includes two features which contribute to the improvement in the acoustic spectrum. First, there are radial extensions 602 from the parabolic surface of the acoustically reflective body 504 to the mounting surfaces 604 of the four legs 606. These "bridging" extensions 602 in the body of the acoustic deflector 502 disrupt the circular symmetry of the acoustically reflective surface and thereby reduce or eliminate the ability of the volume between the acoustic driver 102 and the acoustic deflector 502 (i.e., the acoustic radiation path) to support circularly symmetric modes.

In other examples, the numbers of legs 606 and extensions 602, or other features radially extending from the motion axis (vertical dashed line 506 (FIG. 5B)) of the acoustic driver 508, are different. Alternatively or additionally, the omni-directional acoustic deflectors described herein may include one or more recesses (e.g., a notch or a groove) disposed along the acoustically reflective surface, such as those described in co-pending U.S. patent application Ser. No. 15/221,906, titled "OMNI-DIRECTIONAL SPEAKER SYSTEM AND RELATED DEVICES AND METHODS," filed concurrently herewith on Jul. 28, 2016, which may contribute to the disruption of certain acoustic modes.

The second feature of the omni-directional acoustic deflector 30 that results in an improvement in the acoustic spectrum is the presence of one or more acoustically absorbing regions disposed along the acoustically reflective surface. FIG. 6B shows one of these regions at an opening 608 centered on the axis 610 at the top of the acoustically reflective body 504 in which acoustically absorbing material 614 is disposed (FIG. 6B). This acoustically absorbing material 614 attenuates the acoustic energy present near and at the peak of the lowest order circularly symmetric resonance mode. In some implementations, the diameter of the opening 608 is chosen so that the resulting attenuation of the acoustic energy propagating from the acoustic driver 508 (FIG. 5B) is limited to an acceptable level while achieving a desirable level of smoothing of the acoustic spectrum.

Alternatively or additionally, openings in the form of slots, each containing acoustically absorbing material, may be located along portions of a circumference of the of the acoustically reflective body 504, such as described in co-pending U.S. patent application Ser. No. 14/643,216. And/ or, one or a pattern of openings 616 (FIG. 6B) may be provided along a circumference of the acoustically reflective body to allow air flow between the acoustic radiation path and the body cavity 618 of the acoustically reflective body, which may disrupt/inhibit resonance modes.

In various implementations, the acoustically absorbing material 614 is a foam. In one example, the open region in the body cavity 618 of the acoustic deflector 502, shown in FIG. 6B beneath the parabolic surface, is filled with a single volume of foam such that the foam is adjacent to, or extends into, the opening 608. Alternatively, a separate foam element may be disposed at the opening 608 so that only a portion of the body cavity 618 is occupied by foam. In one example, the foam is coated with a water resistant material. In one implementation, the foam present at the central opening 608 is at one end of a cylindrically-shaped foam element disposed within the body cavity 618.

In another example, the acoustically absorbing material 614 is an acoustically absorbing fabric or screen. The fabric may be disposed within the opening 608 or inside the internal cavity 618 of the cone adjacent to the opening 608. The fabric is acoustically transparent to a degree; however, the acoustic resistance can be tune by using different fabrics. Advantageously, the fabric avoids the need for using one or more large volumes of foam as the inside surface of the acoustic deflector body can be lined with the fabric. In addition, the fabric can be water resistant without the need to apply a water resistant coating. One example of a suitable fabric for some implementations is Saatifil Acoustex 145 available from SaatiTech U.S.A. of Somers, N.Y. or weaved metal mesh screens available from Cleveland Wire Cloth & Manufacturing Company of Cleveland, Ohio, and/or G. BOPP+ CO. AG of Zurich, Switzerland.

Advantageously, leaving at least a portion of the volume of the cavity 618 within the acoustic deflector body unoccupied by the acoustically absorbing material 614 enables the unoccupied volume to be populated by other system components, such as electronic components, and can thereby reduce the size of the omni-directional speaker system 500.

Figure 7:
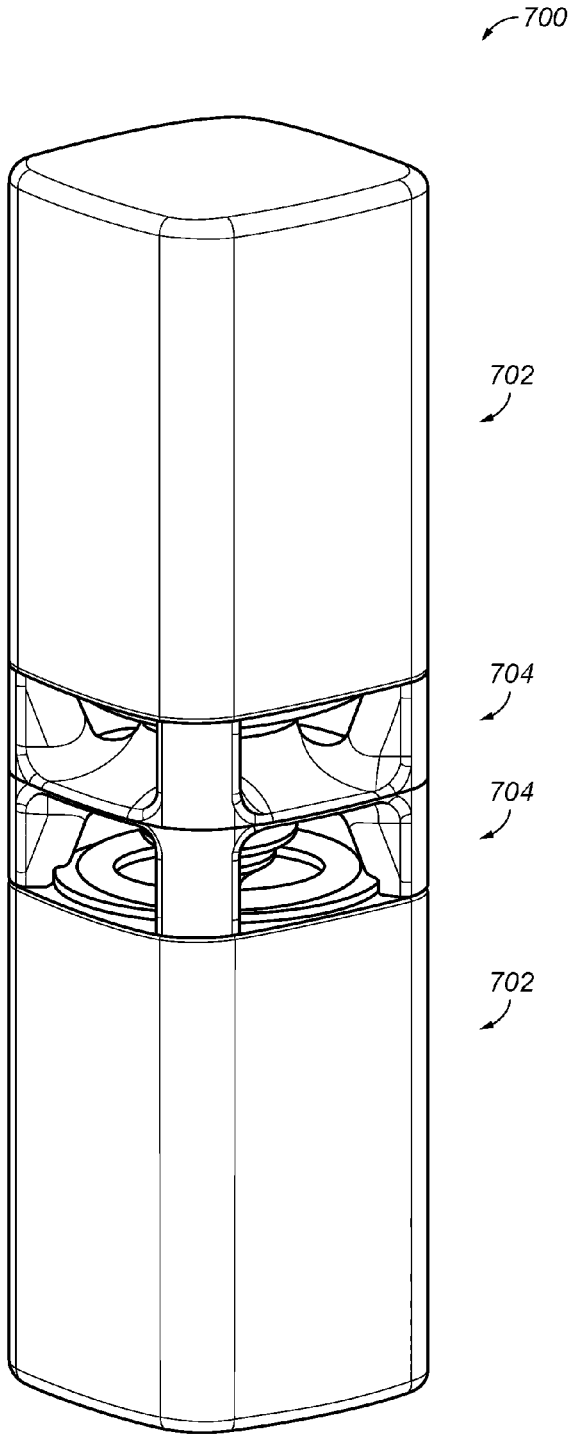
FIG. 7 is a perspective view of an example of an omni-directional satellite speaker system having a pair of acoustic drivers and a pair of omni-directional acoustic deflectors to reduce the negative effects of resonances on the acoustic spectrum according to principles described herein.

In another implementation shown in FIG. 7, an omni-directional satellite speaker system 700 includes a pair of acoustic drivers. Each acoustic driver is secured inside a vertical acoustic enclosure 702. One of the acoustic drivers is configured to provide acoustic energy in an upward direction and the other acoustic driver is positioned to face in an opposite direction so that acoustic energy propagates in a downward direction. The system also includes two omni-directional acoustic deflectors 704, each positioned near the face of a respective one of the acoustic drivers and having acoustic acoustically absorbing material as described in the various examples above. Such a system can be compact and narrow, with the vertical dimension being the longest dimension. In one example, the omni-directional satellite speaker system 700 includes two speaker subsystems, each similar to the speaker system 500 shown in FIG. 5A. One of the speaker subsystems is vertically inverted and adjacent to the other speaker subsystem. An omni-directional satellite speaker system configured in this way can employ smaller active drivers to achieve the same acoustic output of a single active driver system and therefore can have a smaller footprint.

In general, omni-directional acoustic deflectors according to principles described herein act as an acoustic smoothing filter by providing a modified acoustic resonance volume between the acoustic driver and the acoustic deflector. It will be appreciated that adjusting the size and locations of the acoustically absorbing regions allows for the acoustic spectrum to be tuned to modify the acoustic spectrum. Similarly, the profile of the acoustically reflecting surface may be non-linear (i.e., vary from a perfect conical surface) and defined so as to modify the acoustic spectrum. In addition, non-circularly symmetric extensions in the acoustically reflecting surface, such as the radial extensions described above, can be utilized to achieve an acceptable acoustic spectrum.

A number of implementations have been described. Nevertheless, it will be understood that additional modifications may be made without departing from the scope of the inventive concepts described herein.

What is claimed is:

1. An omni-directional acoustic deflector, comprising:

an acoustically reflective body having a truncated conical shape including a substantially conical outer surface configured to be disposed adjacent an acoustically radiating surface of an acoustic driver thereby to define an acoustic radiation path therebetween, wherein the acoustically reflective body is profiled such that a cross-sectional area of the acoustic radiation path increases monotonically with respect to radial distance from a motion axis of the acoustic driver, wherein the substantially conical outer surface has a non-linear slant profile wherein the cross-sectional area of the acoustic radiation path increases in a nonlinear fashion with respect to distance from a motion axis of the acoustic driver, and wherein the substantially conical outer surface has a substantially parabolic profile, wherein the cross-sectional area of the acoustic radiation path increases in a highly nonlinear fashion with respect to distance from the motion axis of the acoustic driver.

2. The omni-directional acoustic deflector of claim 1, wherein one or a pattern of openings are provided along a circumference of the acoustically reflective body to allow for air flow between the acoustic radiation path and a body cavity of the acoustically reflective body, thereby to disrupt or inhibit resonance modes.

3. An omni-directional acoustic deflector, comprising:

an acoustically reflective body having a truncated conical shape including a substantially conical outer surface configured to be disposed adjacent an acoustically radiating surface of an acoustic driver thereby to define an acoustic radiation path therebetween, wherein the acoustically reflective body is profiled such that a cross-sectional area of the acoustic radiation path increases monotonically with respect to radial distance from a motion axis of the acoustic driver, wherein the acoustically reflective body comprises one or more features that extend into the acoustic radiation path and which disrupt a circular symmetry of the acoustic body, and thereby reduce the ability of the acoustic radiation path to support circularly symmetric modes.

4. The omni-directional acoustic deflector of claim 3, wherein the substantially conical outer surface has a steeper slope than the acoustically radiating surface.

5. The omni-directional acoustic deflector of claim 3, wherein the substantially conical outer surface has a linear slant profile wherein the cross-sectional area of the acoustic radiation path increases in linear fashion with respect to distance from a motion axis of the acoustic driver.

6. The omni-directional acoustic deflector of claim 3, wherein the omni-directional acoustic deflector comprises a leg for coupling the acoustically reflective body to the acoustic driver, and wherein the one or more features comprise a radial extension that extends from the acoustically reflective body to the at least one leg.

7. The omni-directional acoustic deflector of claim 3, wherein one or a pattern of openings are provided along a circumference of the acoustically reflective body to allow for air flow between the acoustic radiation path and a body cavity of the acoustically reflective body, thereby to disrupt or inhibit resonance modes.

8. An omni-directional acoustic deflector, comprising:

an acoustically reflective body having a truncated conical shape including a substantially conical outer surface configured to be disposed adjacent an acoustically radiating surface of an acoustic driver thereby to define an acoustic radiation path therebetween, wherein the acoustically reflective body is profiled such that a cross-sectional area of the acoustic radiation path increases monotonically with respect to radial distance from a motion axis of the acoustic driver, wherein the acoustically reflective body comprises a top surface configured to be centered with respect to a motion axis of the acoustic driver, the acoustically reflective body having an opening in the top surface, and the omni-directional deflector further comprising an acoustically absorbing material disposed at the opening in the top surface.

9. The omni-directional acoustic deflector of claim 8, wherein one or a pattern of openings are provided along a circumference of the acoustically reflective body to allow for air flow between the acoustic radiation path and a body cavity of the acoustically reflective body, thereby to disrupt or inhibit resonance modes.

10. A speaker system comprising:

an acoustic enclosure;

an acoustic driver disposed coupled to the acoustic enclosure; and an omni-directional acoustic deflector coupled to the acoustic enclosure adjacent the acoustic driver to receive acoustic energy propagating from the acoustic driver, the omni-directional acoustic deflector comprising:

an acoustically reflective body having a truncated conical shape including a substantially conical outer surface configured to be disposed adjacent an acoustically radiating surface of the acoustic driver thereby to define an acoustic radiation path therebetween, wherein a slope of a profile of the substantially conical outer surface does not correspond to that of the acoustically radiating surface, wherein the substantially conical outer surface comprises a non-linear profile, and wherein the substantially conical outer surface has a substantially parabolic profile.

11. The speaker system of claim 10, wherein the acoustically reflective body is profiled such that a cross-sectional area of the acoustic radiation path increases monotonically with respect to radial distance from a motion axis of the acoustic driver.

12. The speaker system of claim 10, further comprising at least one passive radiator.

13. The speaker system of claim 10, wherein one or more openings are provided along a circumference of the acoustically reflective body to allow for air flow between the acoustic radiation path and a body cavity of the acoustically reflective body, thereby to disrupt or inhibit resonance modes.

14. A speaker system comprising:

an acoustic enclosure;

an acoustic driver disposed coupled to the acoustic enclosure; and an omni-directional acoustic deflector coupled to the acoustic enclosure adjacent the acoustic driver to receive acoustic energy propagating from the acoustic driver, the omni-directional acoustic deflector comprising:

an acoustically reflective body having a truncated conical shape including a substantially conical outer surface configured to be disposed adjacent an acoustically radiating surface of the acoustic driver thereby to define an acoustic radiation path therebetween, wherein a slope of a profile of the substantially conical outer surface does not correspond to that of the acoustically radiating surface, wherein the acoustically reflective body comprises one or more features that extend into the acoustic radiation path and which disrupt a circular symmetry of the acoustic body, and thereby reduce the ability of the acoustic radiation path to support circularly symmetric modes.

15. The speaker system of claim 14, wherein the profile of the substantially conical outer surface has a steeper slope than the acoustically radiating surface.

16. The speaker system of claim 14, wherein the substantially conical outer surface comprises a linear profile.

* * * * *